US006764025B1

(12) United States Patent
Espina

(10) Patent No.: US 6,764,025 B1
(45) Date of Patent: Jul. 20, 2004

(54) ISOLATING ASSEMBLY FOR SPRINKLERS

(76) Inventor: Lazaro R. Espina, 245 W. 39 Pl., Hialeah, FL (US) 33012

( * ) Notice: Subject to any disclaimer, the term of this patent is extended or adjusted under 35 U.S.C. 154(b) by 232 days.

(21) Appl. No.: 10/411,947

(22) Filed: Apr. 14, 2003

(51) Int. Cl.[7] ..... B05B 15/04

(52) U.S. Cl. ..... 239/288; 239/200; 239/201; 239/203; 239/288.3; 239/288.5; D23/227

(58) Field of Search ..... 239/104, 200, 239/201, 202, 203, 204, 205, 206, 207, 210, 288, 288.3, 288.5; D23/213, 214, 217, 218, 227

(56) References Cited

U.S. PATENT DOCUMENTS 4,752,033 A * 6/1988 Groendyke ..... 239/288
5,213,262 A * 5/1993 Violette ..... 239/203
5,938,121 A * 8/1999 Ferguson et al. ..... 239/203
6,494,386 B1 * 12/2002 Banu ..... 239/288

FOREIGN PATENT DOCUMENTS

AU 9333166 A * 8/1993 ..... B05B/15/06

* cited by examiner

*Primary Examiner*—Robin O. Evans

(57) ABSTRACT

An assembly for isolating and protecting the head and shaft of sprinklers from the surrounding soil, vegetation and external impacts, once it is installed into the ground. The assembly including a tubular chamber having an upper opened end and a lower threaded opening that allows the connection of the sprinkler with the water supply, the dimensions inside the tubular chamber are enough for a user's hand to manipulate the sprinkler shaft. This assembly further includes a retention ring mounted into a shield member that in turn is mounted to the tubular chamber and kept in place by a locking mechanism. The sprinkler shaft is housed inside the tubular chamber while the sprinkler head is protected in a recess defined by the inner lateral wall of the shield and a rubber gasket.

15 Claims, 2 Drawing Sheets

ISOLATING ASSEMBLY FOR SPRINKLERS

BACKGROUND OF THE INVENTION

1. Field of the Invention

The present invention relates to an isolating assembly for sprinklers, and more particularly, to the type that is partially installed below the ground and is designed to isolate and protect a sprinkler from the surrounding soil and vegetation once it is installed.

2. Description of the Related Art

Many devices for protecting the body and/or head of a sprinkler exist nowadays. However, none of them discloses the features of the present invention. The present invention discloses an assembly that is removable and easy to operate in order to protect both the body and the head of a sprinkler. Additionally, this invention is an assembly of a number of parts wherein each of them can be replaced in the event of damage. Finally, the disclosed invention is also easy and less costly to manufacture in comparison with others existing in the market.

SUMMARY OF THE INVENTION

It is one of the main objects of the present invention to provide an assembly that isolates a sprinkler from the surrounding soil and vegetation.

It is another object of this invention to provide an assembly that has such a configuration that provides protection to sprinkler head from lateral and downward impacts.

It is another object of this invention to provide an assembly that allows a user to easily remove and/or replace the damaged sprinkler.

It is another object of this invention to provide an assembly that permits a user to remove the sprinkler from the water supply without the possibility of contamination of the water system with soil and grass.

It is still another object of this invention to provide an assembly that is simple to install into the ground.

It is yet another object of this invention to provide such a device that is inexpensive to manufacture and maintain while retaining its effectiveness.

Further objects of this invention will be brought out in the following part of the specifications, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figures 1, 1A:
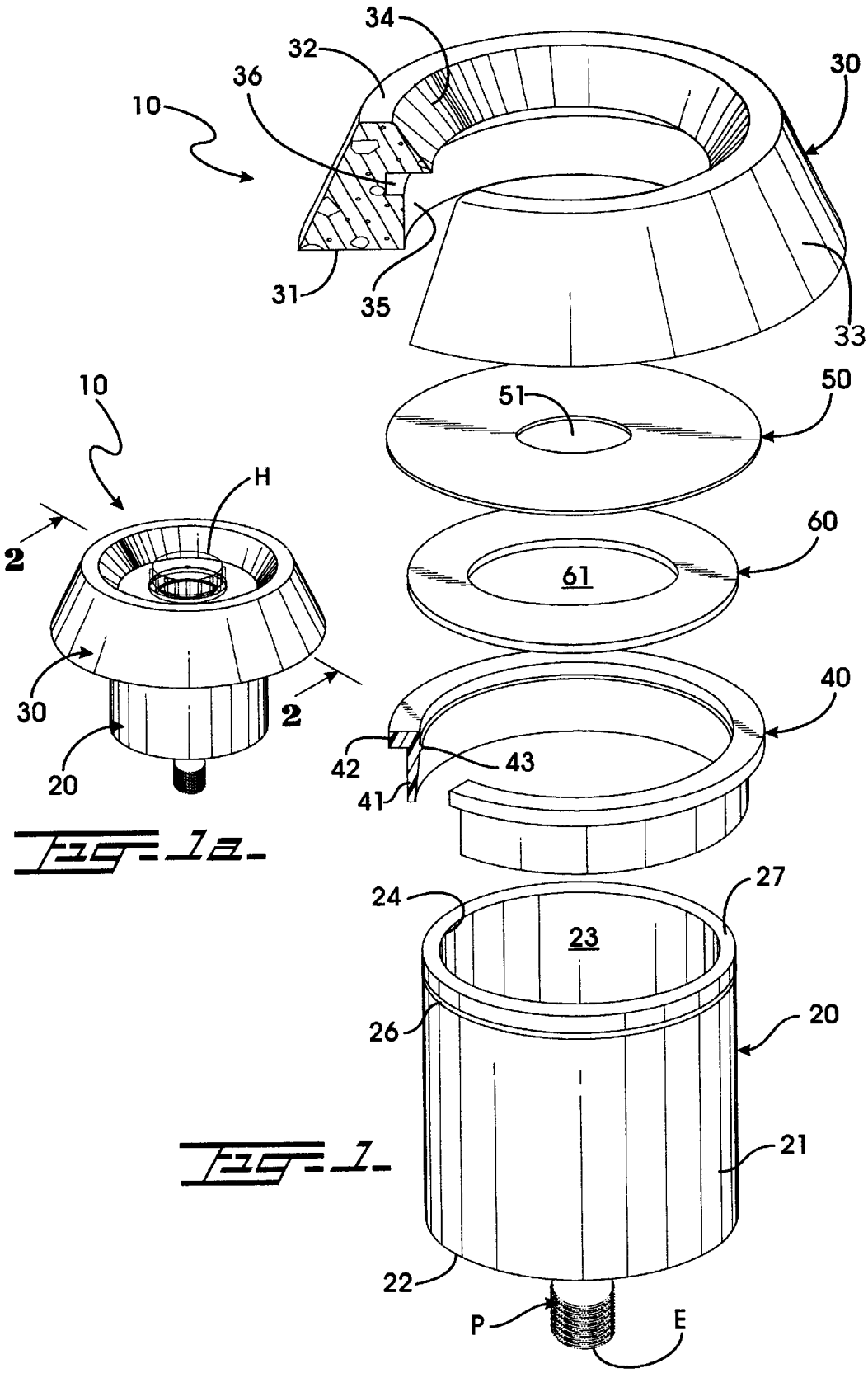
FIG. 1 is an exploded isometric view from the top of the present invention. Also, a partial cross section of the shield member and retention ring are shown.
FIG. 1*a* is an isometric view from the top of the present invention isolating and protecting a sprinkler from the surrounding ground.

As illustrated in FIG. 1, isolating assembly 10 basically includes tubular chamber 20, shield member 30, retention ring 40, gasket 50 and supporting washer 60.

Figure 2:
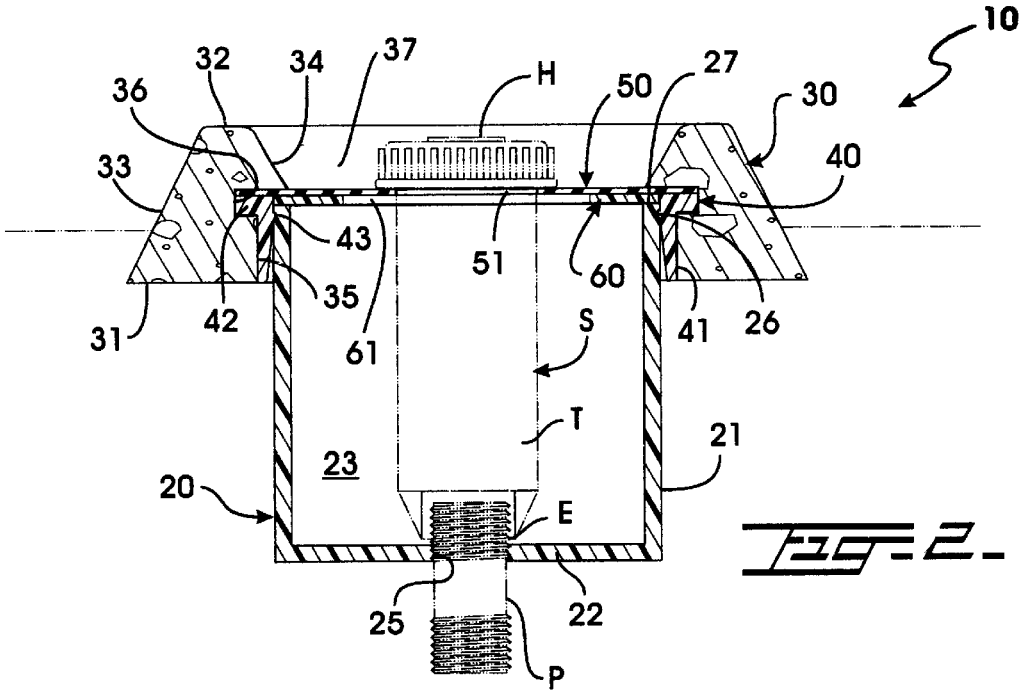
FIG. 2 is a cross-sectional elevational view of the preferred embodiment, taken along line 2—2. A sprinkler S is illustrated in phantom.
Figure 3:
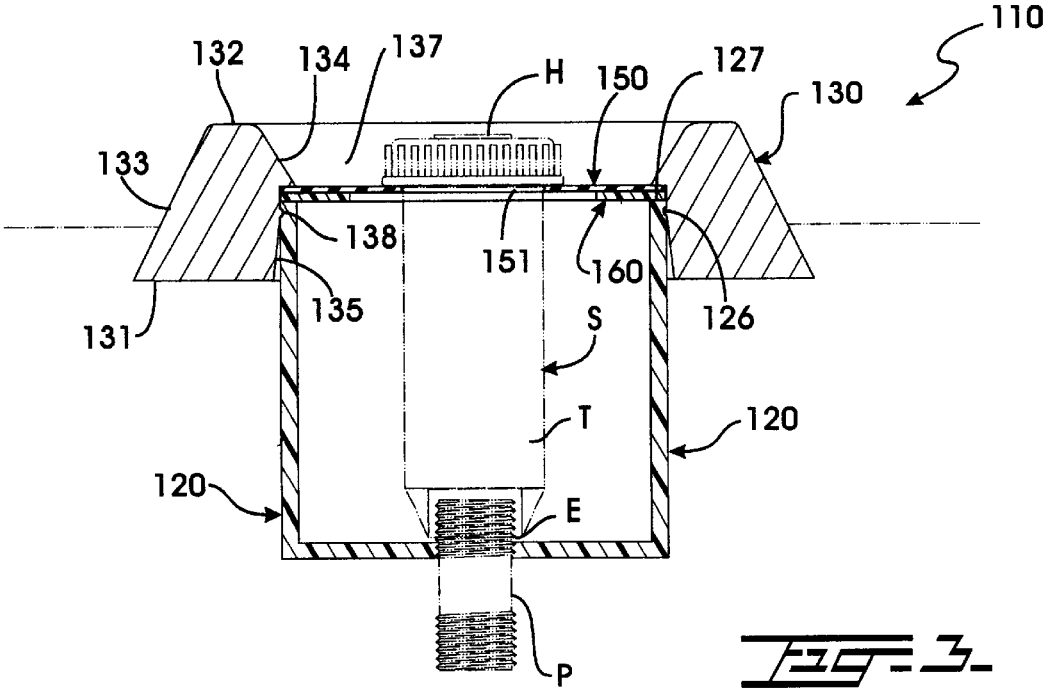
FIG. 3 is a cross-sectional elevational view of the alternative embodiment. A sprinkler S is illustrated in phantom.

Tubular chamber 20 includes lateral circular cross-sectional wall 21, bottom wall 22, inner space 23, upper opened end 24 and lower threaded opening 25. Lower threaded opening 25 is located in the central axis of tubular chamber 20 and is configured to cooperatively receive threaded end E of water supply pipe P therethrough. Additionally, tubular chamber 20 has annular groove 26 horizontally disposed on the outer surface of lateral wall 21 and in parallel relationship with respect to upper end 24. Annular groove 26 is positioned around the periphery of chamber 20. Tubular chamber 20 has a diameter enough to receive a conventional sprinkler S inside space 23 without interference with lateral wall 21, as best seen in FIGS. 2 and 3. Also, space 23 allows a user's hand to manipulate sprinkler shaft T and/or connecting end E.

Shield member 30 is one of the main parts of the present invention. As best seen in FIGS. 1 and 2, shield member 30 has a flared configuration basically defined by base wall 31, upper edge or wall 32, outer lateral wall 33, inner lateral walls 34 and 35. Base wall 31 is geometrically larger than wall 32 to enhance the vertical stability of shield 30 with respect to planar ground level. Shield member 30 has, in the preferred embodiment, cavity 36 that is inwardly disposed on inner lateral wall 35. Cavity 36 is designed to cooperatively receive shoulder 42 of retention ring 40 therein. Shield member 30 is preferably made out of concrete material so that a grass-cutting machine cannot damage its configuration.

Retention ring 40, as shown in FIGS. 1 and 2, includes lateral wall 41 and upper shoulder 42 rigidly mounted thereto. Upper shoulder 42 outwardly projects from the uppermost portion of wall 41. Also, wall 41 has flange 43 that is outwardly projected towards the central axis of retention ring 40, and along thereof. Flange 43 acts as a locking member. Retention ring 40 and tubular chamber 20 can be made out of a plastic high temperature resistant material.

Gasket 50, in the preferred embodiment, has an annular configuration and includes opening 51. Opening 51 is configured to receive a sprinkler shaft T therethrough and is in central alignment with threaded opening 25 of bottom wall 22, as best seen in FIG. 2. Gasket 50 rests, at the distal outer end, on shoulder 42 that in turn both are placed inside cavity 36 of shield 30. In this manner, gasket 50 is secured in place. Gasket 50 is preferably made out of a rubber material. The elastic characteristic of this material allows different diameters of sprinkler shaft T to be used, while keeping hermetic passage between opening 51 and shaft T.

Tubular chamber 20 is installed into the ground, over the water supply line for sprinkler system. A user screws chamber 20 onto underground threaded end E of pipe P. Then, supporting washer 60 is placed on edge 27 of chamber 20. Washer 60 has opening 61. Washer 60 is made out of a hard plastic material and is mainly configured to support gasket 50 and/or any other external downward force. Washer 60 can be rigidly mounted to gasket 50. Shield member 30, along with retention ring 40 and gasket 50 previously assembled thereto, is mounted onto tubular chamber 20. Flange 43 (or male member) of retention ring 40 snaps into annular groove 26 (or female member) of chamber 20, as is illustrated in FIG. 2. In this manner, shield member 30 is locked and thus kept in placed. Shield member 30 is partially placed bellow the ground. Finally, a user inserts sprinkler shaft T through opening 51 of gasket 50 and screws its threaded connecting end to pipe P. In this manner, sprinkler shaft T is embedded in the ground isolated by chamber 20 and sprinkler head H rests within recess 37 and protected by shield 30. Recess 37 is defined by lateral wall 34 and gasket 50. Recess 37 is configured in such manner that a user's hand has easy access to manipulate sprinkler head H. Upper edge or wall 32 of shield member 30 is flush with sprinkler head H or even higher, so that a grass-cutting machine could not damage sprinkler S.

When the sprinkler filter needs to be cleaned and/or replaced, a user easily actuates head H and removes sprinkler S by unscrewing it from water pipe end E. In the event assembly 10 needs to be disassembled, a user grasps shield 30 and applying a force upwardly towards his/her body, flange 43 unsnaps from annular groove 26. In this manner, shield 30 along with gasket 50 and washer 60 are removed, therefore leaving chamber 20 opened for any maintenance in its interior.

FIG. 3 illustrates alternative embodiment 110. Isolating assembly 110 basically includes tubular chamber 120, shield member 130, gasket 150 and supporting washer 160. Alternative embodiment 110 does not include retention ring 40 of embodiment 10, as shield member 130 substitutes the locking function of ring 40.

Shield member 130 has a flared configuration basically defined by base wall 131, upper edge or wall 132, outer lateral wall 133, inner lateral walls 134 and 135. Shield member 130 has, in the alternative embodiment, locking member or flange 138. Flange 138 protrudes toward the central axis of shield member 130, and is configured to snugly and cooperatively fit into annular groove 126 of tubular chamber 120. Shield member 130 is preferably made out of a moldable material such as a high-temperature and impact resistant plastic or the like.

Tubular chamber 120 is installed into the ground, over the water supply line for sprinkler system. A user screws chamber 120 onto underground threaded end E of pipe P. Then, supporting washer 160 and gasket 150 are placed on edge 127 of chamber 120. Shield member 130 is removably mounted onto tubular chamber 120. Flange or locking member 138 snaps into annular groove 126, the latter is disposed on the periphery of chamber 120, as is illustrated in FIG. 3. In this manner, shield member 130 is locked to chamber 120. Shield member 130 is partially placed bellow the ground to keep it in place. Finally, a user inserts sprinkler shaft T through opening 151 of gasket 150 and screws its threaded connecting end to pipe P. In this manner, sprinkler shaft T is embedded in the ground isolated by chamber 120 and sprinkler head H rests within recess 137 and protected by shield 130.

The foregoing description conveys the best understanding of the objectives and advantages of the present invention. Different embodiments may be made of the inventive concept of this invention. It is to be understood that all matter disclosed herein is to be interpreted merely as illustrative, and not in limiting sense.

What is claimed is:

1. An assembly for isolating and protecting the head and shaft of sprinklers, comprises:

a tubular chamber including a lateral circular cross-sectional wall, a bottom wall, an inner space, an upper opened end, an upper edge and a lower threaded opening, the dimensions of said inner space are enough for a user's hand to manipulate a sprinkler shaft, and wherein said lower threaded opening is located in the central axis of said bottom wall and allows the connection of a sprinkler with the water supply, and wherein said lateral circular cross-sectional wall has a groove disposed along the periphery thereof;

a shield member including a base wall, an upper wall, an outer lateral wall, a first and second inner lateral walls, and a recess, wherein said base wall is geometrically larger than said upper wall to enhance the vertical stability of said shield member, and said first inner lateral wall has a cavity;

a retention ring including a lateral wall and an upper shoulder rigidly mounted thereto; and a gasket including an opening.

2. The assembly set forth in claim 1 further includes a washer member for supporting said gasket, and said washer member is placed on said upper edge of said lateral circular cross-sectional wall.

3. The assembly set forth in claim 2 wherein said upper shoulder is cooperatively received within said cavity of said retention ring.

4. The assembly set forth in claim 3 wherein said lateral wall of said retention ring has a flange member outwardly projected and toward the central axis of said retention ring.

5. The assembly set forth in claim 4 wherein said flange member snaps into said groove of said tubular chamber so that said shield member is locked to said tubular chamber.

6. The assembly set forth in claim 5 wherein said gasket has an outer distal end which is placed over said upper shoulder, that in turn are disposed within said cavity so that said gasket is secured in place, and wherein said gasket is made out of a rubber material.

7. The assembly set forth in claim 6 wherein said opening of said gasket is configured to snugly and cooperatively receive the sprinkler shaft therethrough.

8. The assembly set forth in claim 7 wherein said recess is defined by said second lateral wall of said shield member and said gasket, and the sprinkler head is disposed within said recess.

9. An assembly for isolating and protecting the head and shaft of sprinklers, comprises:

a tubular chamber including a lateral circular cross-sectional wall, a bottom wall, an inner space, an upper opened end, an upper edge and a lower threaded opening, the dimensions of said inner space are enough for a user's hand to manipulate a sprinkler shaft, and wherein said lower threaded opening is located in the central axis of said bottom wall and allows the connection of a sprinkler with the water supply, and wherein said lateral circular cross-sectional wall has a groove disposed along the periphery thereof;

a shield member including a base wall, an upper wall, an outer lateral wall, a first and second inner lateral walls, and a recess, wherein said base wall is geometrically larger than said upper wall to enhance the vertical stability of said shield member; and a gasket including an opening.

10. The assembly set forth in claim 9 further includes a washer member for supporting said gasket, and said washer member is placed on said upper edge of said lateral circular cross-sectional wall.

11. The assembly set forth in claim 10 wherein said first inner lateral wall of said shield member has a flange member outwardly projected and toward the central axis of said shield member.

12. The assembly set forth in claim 11 wherein said flange member snaps into said groove of said tubular chamber so that said shield member is locked to said tubular chamber.

13. The assembly set forth in claim 12 wherein said gasket is placed over said washer, that in turn is placed on said upper edge of said tubular chamber, and wherein said gasket is made out of a rubber material.

14. The assembly set forth in claim 13 wherein said opening of said gasket is configured to snugly and cooperatively receive the sprinkler shaft therethrough.

15. The assembly set forth in claim 14 wherein said recess is defined by said second lateral wall of said shield member and said gasket, and the sprinkler head is disposed within said recess.

* * * * *